US007676863B2

(12) United States Patent
Henning

(10) Patent No.: US 7,676,863 B2
(45) Date of Patent: Mar. 16, 2010

(54) BED SKIRT ASSEMBLY

(76) Inventor: Sharon K. Henning, 1636 Short Rd., Curtice, OH (US) 43412-9773

( * ) Notice: Subject to any disclaimer, the term of this patent is extended or adjusted under 35 U.S.C. 154(b) by 0 days.

(21) Appl. No.: 12/414,720

(22) Filed: Mar. 31, 2009

(65) Prior Publication Data

US 2009/0249550 A1 Oct. 8, 2009

Related U.S. Application Data

(60) Provisional application No. 61/042,064, filed on Apr. 3, 2008.

(51) Int. Cl.
*A47G 9/04* (2006.01)

(52) U.S. Cl. ..... 5/493

(58) Field of Classification Search ..... 5/493, 5/482, 922, 496, 498; 24/72.5
See application file for complete search history.

(56) References Cited

U.S. PATENT DOCUMENTS

| | | | | |
|---|---|---|---|---|
| 2,763,875 | A * | 9/1956 | Piontkowski | 5/493 |
| 4,587,683 | A | 5/1986 | Gardiner | |
| 4,734,947 | A | 4/1988 | Vitale | |
| 4,796,317 | A * | 1/1989 | Kallman et al. | 5/493 |
| 5,086,531 | A * | 2/1992 | Carlos | 5/493 |
| 5,205,003 | A | 4/1993 | Green | |
| 5,240,758 | A * | 8/1993 | Honigberg | 428/100 |
| 5,335,383 | A | 8/1994 | Schwind | |
| 5,438,719 | A | 8/1995 | Anthony | |
| 5,621,931 | A | 4/1997 | Hamilton | |
| 5,638,562 | A | 6/1997 | Masoncup | |
| 5,946,750 | A * | 9/1999 | Shiu | 5/502 |
| 6,035,469 | A | 3/2000 | Schrougham | |
| 6,044,503 | A | 4/2000 | McClendon | |
| 6,119,290 | A | 9/2000 | Masoncup | |
| 6,276,009 | B1 | 8/2001 | Schrougham | |
| 6,427,266 | B2 | 8/2002 | Talley-Williams | |
| 7,140,053 | B1 | 11/2006 | Mangano | |
| 7,325,263 | B2 | 2/2008 | Stribling | |
| 2007/0022534 | A1 * | 2/2007 | Richards | 5/493 |

* cited by examiner

*Primary Examiner*—Alexander Grosz
(74) *Attorney, Agent, or Firm*—Fraser Clemens Martin & Miller LLC; J. Douglas Miller

(57) ABSTRACT

A bed skirt adapted to be removably attached to an associated bed sheet is disclosed. The bed skirt includes a first decorative side and a second decorative side. The bed sheet includes a top and an edge portion adapted to fit over one of a mattress and a box spring. A plurality of fasteners is provided to removably attach the bed skirt to the edge portion of the bed sheet, wherein one of the first decorative side and the second decorative side is outwardly facing.

3 Claims, 1 Drawing Sheet

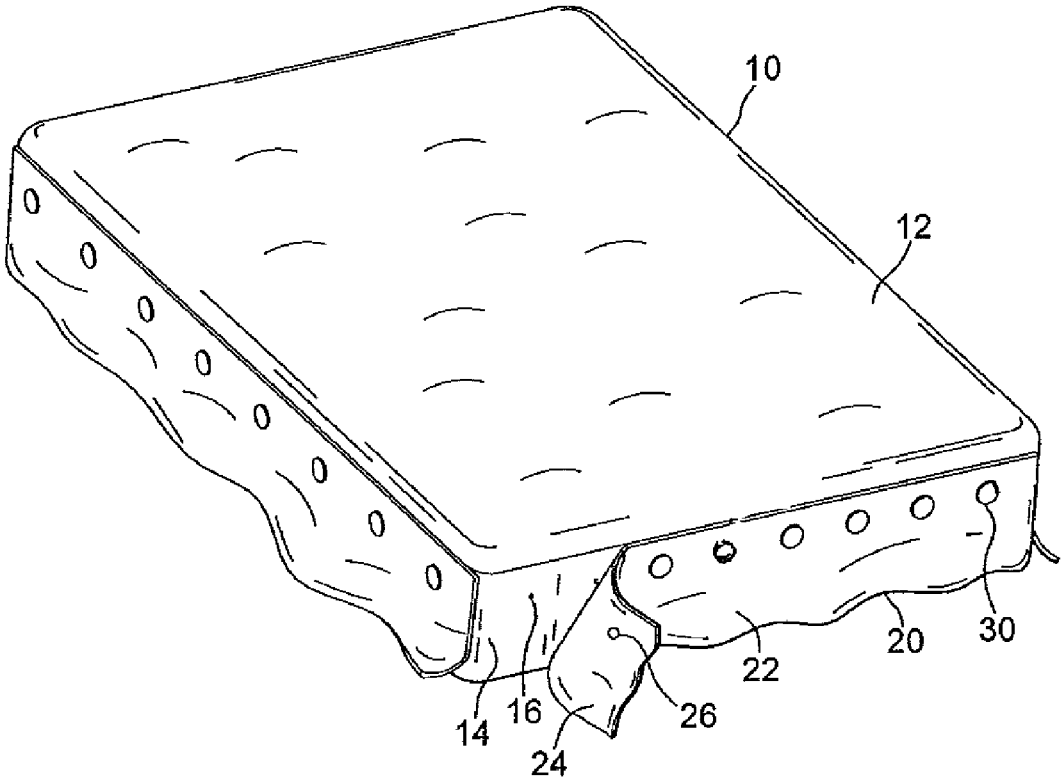
10
12
14
16
24
26
22
20
30

BED SKIRT ASSEMBLY

CROSS-REFERENCE TO RELATED APPLICATION

This application claims the benefit of U.S. Provisional Patent Application Ser. No. 61/042,064 filed on Apr. 3, 2008.

FIELD OF THE INVENTION

The invention relates to a bed skirt assembly, and more specifically to a reversible bed skirt adapted to be removably attached to an associated bed sheet.

BACKGROUND OF THE INVENTION

Conventional bed skirts or dust ruffles comprise a skirt that is attached to the outer periphery of a mattress or a box spring of a bed. The bed skirt typically depends from the box spring and covers the sides of the box spring and the space between the floor and the box spring to provide a decorative appearance to the bed ensemble.

The conventional bed skirt is typically formed integral with a fitted bed sheet. The fitted sheet portion covers a top surface and sides of the box spring while the bed skirt material depends from the sheet and extends downward toward the floor. In order to install or remove the conventional bed skirt, a user must remove a mattress; position the fitted bed sheet with the bed skirt over the box spring; and return the mattress back in position on top of the box spring. The difficulty of removing and repositioning the mattress causes some individuals to forego employing a bed skirt; to seldom remove the bed skirt for cleaning; or seldom change the bed skirt to alter the decorative appearance of the bed ensemble.

Other bed skirts have sought to provide a bed skirt that eliminates the requirement of removing the mattress to install and/or remove the bed skirt. The other bed skirts have employed a "tucking method" that requires a portion of the bed skirt to be inserted between the mattress and the box spring. Elastic members or other fastening members have been combined with the "tucking method" to facilitate the positioning and securing of the bed skirt in respect of the box spring, examples of which are disclosed in U.S. Pat. No. 5,638,562 to Masoncup and U.S. Pat. No. 6,035,469 to Schrougham. This type of bed skirt still requires some lifting of the mattress during the tucking operation and makes it difficult to create an even hang of the bed skirt from the box spring.

Other bed skirts employ a fastener such as a snap or a hook and loop tape to attach the bed skirt to a fitted member or a fitted sheet placed over the mattress or box spring. Examples of this type of bed skirt are disclosed in U.S. Pat. No. 2,763,875 to Piontkowski and U.S. Patent Application No. 2007/0022534 of Richards. However, the fasteners detract from the esthetic appearance of the bed skirt and typically cause one side of the bed skirt to have an appearance that is unacceptable for facing outwardly from the bed.

It would be desirable to have a reversible bed skirt adapted to facilitate the attachment of the bed skirt to and the removal of the bed skirt from a bed, and to provide the bed skirt with two decorative sides for selectively facing outwardly from the bed.

SUMMARY OF THE INVENTION

Compatible and attuned with the present invention, a reversible bed skirt adapted to facilitate the attachment of the bed skirt to and the removal of the bed skirt from a bed, and to provide the bed skirt with two decorative sides for selectively facing outwardly from the bed, has surprisingly been discovered.

The above objective, as well as others, may be achieved by a bed skirt assembly comprising a bed skirt having a first decorative side and a second decorative side; and a fastener to removably attach the bed skirt to a support having one of the first decorative side and the second decorative side as an outwardly facing surface.

The above objective may also be achieved by a bedclothes kit for use with a bed comprising a bed skirt having a first decorative side and a second decorative side; and a fastener to removably attach the bed skirt to a support having one of the first decorative side and the second decorative side as an outwardly facing surface.

BRIEF DESCRIPTION OF THE DRAWINGS

The above, as well as other objects and advantages of the invention, will become readily apparent to those skilled in the art from the following detailed description of an embodiment of the invention when considered in the light of the accompanying drawing, in which a perspective view of a reversible bed skirt according to an embodiment of the invention is illustrated showing a portion of the bed skirt detached from a bed sheet.

DETAILED DESCRIPTION OF A PREFERRED EMBODIMENT OF THE INVENTION

The following detailed description and appended drawing describe and illustrate various exemplary embodiments of the invention. The description and drawing serve to enable one skilled in the art to make and use the invention, and are not intended to limit the scope of the invention in any manner.

Referring to the drawing, there is illustrated a bed sheet 10 for covering a box spring (not shown) and a bed skirt 20 attached to the sheet 10. The sheet 10 includes a top 12 and an edge portion 14. The top 12 of the sheet 10 covers the entire upper surface of the box spring. However, it should be understood that the sheet 10 can be adapted to cover only a portion of the upper surface of the box spring such as an area adjacent the edges thereof, for example. The edge portion 14 of the sheet 10 covers the sides of the box spring. The box spring is typically in the shape of a four sided polygon. However, it should be understood that the box spring can have other shapes such as a circle, for example. The shape of the sheet 10 can formed to fit over the box spring. It should be understood that one or more rows of attachment points 16 can be provided along the length of the edge portion 14.

The bed skirt 20 is formed from a pair of strips of fabric sewn together in juxtaposed alignment to provide a first decorative side 22 and a second decorative side 24. It should be understood that the strips of fabric can be joined together by other means such as an adhesive, for example. The bed skirt 20 can include any of a number of selected decorative enhancements such as a lace trim, or other decorative appliqué or edge treatments, for example. The bed skirt 20 includes a separate bed skirt piece for the respective sides of the box spring. However, it should be understood that the bed skirt 20 can be one or more pieces as desired. It should be understood that the bed skirt 20 can be adapted to cover selected sides of the box spring such as the sides and one end, wherein the opposite end is adjacent a wall or a head board and, therefore, not readily visible.

A plurality of apertures 26 is formed in the bed skirt 20 adjacent an edge thereof. The apertures 26 are spaced apart at regular intervals that correspond to the spacing of the attachment points 16 on the edge portion 14 of the sheet 10. A plurality of fasteners 30 is provided to facilitate the attachment of the bed skirt 20 to the edge portion 14 of the sheet 10. However, it should be understood that the fasteners can be adapted to attach the bed skirt directly to the box spring 20. The fasteners 30 extend through the apertures 26 formed in the bed skirt 20 to removably secure the bed skirt 20 to the attachment points 16 on the edge portion 14 of the sheet 10. The fasteners 30 include a selected decorative outer surface to compliment the appearance of the bed skirt 20. It should be understood that one or more sets of the fasteners 30 can be provided, each set having a different selected decorative outer surface. It should be understood that the bed skirt 20 can be formed without the apertures 26 and removably attached to the sheet 10 or the box spring with suitable fasteners 30.

Favorable results have been obtained employing a fastener 30 including a pair of cooperating faster members wherein one of the fasten members is disposed on the edge portion 14 of the sheet 10. It should be understood that the fastener 30 can be a snap type fastener, a hook & eye fastener, a hook and loop tape, a magnetic member, or any other suitable fastener, for example. A button hole can be provided at the attachment points 16 and a fastener such as a pair of buttons joined together in a back-to-back configuration or other cuff-link style fastener, for example, can be employed to removably attach the bed skirt 20 to the sheet 10.

The bed skirt 20 is part of a general group of bedding accessories or bedclothes that also include bed sheets, comforters, covers, blankets, pillows, and pillow cases, for example. It should be understood that the bed skirt 20 can be combined with the other such accessories to provide a coordinated set of bedclothes having selected decorative patterns. The accessories can be employed in selected combinations with the bed skirt 20 to provide a desired decorative appearance to a bed ensemble.

The sheet 10 can be employed to cover a mattress and the bed skirt 20 can be adapted to depend therefrom and cover the sides of the mattress and the box spring.

In use, a user removes the mattress from the bed and places the sheet 10 over the underlying box spring. The mattress is repositioned over the box spring. One of the decorative sides 22, 24 of the bed skirt 20 is selected as the outward facing surface. The apertures 26 formed in the bed skirt 20 are placed in alignment with the attachment points 16 on the edge portion 14 of the sheet 10. The fasteners 30 are employed to removably attach the bed skirt 20 to the sheet 10.

After the initial installation of the sheet 10, the bed skirt 20 can be removed from the bed ensemble quickly and easily without having to remove the mattress. The bed skirt 20 can be readily removed from the sheet 10 for washing or ironing, for example. The bed skirt 20 can be easily removed and positioned to have the opposite decorative side face outwardly to provide an alternate appearance for the bed ensemble. One or more additional sets of the fasteners 30 can be employed having a different decorative outer surface to provide an alternate appearance to either the first decorative side 22 or the second decorative side 24 of the bed skirt 20.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A bed skirt assembly comprising:

a reversible bed skirt having a first decorative side and a second decorative side; an aperture formed in the bed skirt, extending from the first decorative side to the second decorative side, a bed sheet having an edge portion for covering a vertical side of one of a mattress and a box spring, the edge portion including a first snap type fastening member attached thereto; and a second snap type fastening member adapted to couple to the first fastening member to removably attach the bed skirt to the edge portion of the bed sheet to selectively position one of the first decorative side and the second decorative side as an outwardly facing surface, wherein at least a portion of the bed skirt is disposed between the first fastening member and the second fastening member when the second fastening member is coupled to the first fastening member the aperture facilitating the coupling of the second fastening member to the first fastening member.

2. The bed skirt assembly according to claim 1, wherein the bed skirt is formed from strips of fabric joined together in juxtaposed alignment.

3. The bed skirt assembly according to claim 1, wherein the second fastening member includes a decorative surface as an outwardly facing surface.

* * * * *